US010421635B2

(12) United States Patent
Lee et al.

(10) Patent No.: US 10,421,635 B2
(45) Date of Patent: Sep. 24, 2019

(54) LENGTH ADJUSTING MECHANISM OF SLITTER REWINDER

(71) Applicant: JineWei Industry Co., Ltd, Taoyuan (TW)

(72) Inventors: Tseng-Tien Lee, Taoyuan (TW); Yu-Sheng Lee, Taoyuan (TW)

(73) Assignee: JineWei Industry Co., Ltd, Taoyuan (TW)

( * ) Notice: Subject to any disclaimer, the term of this patent is extended or adjusted under 35 U.S.C. 154(b) by 278 days.

(21) Appl. No.: 15/427,063

(22) Filed: Feb. 8, 2017

(65) Prior Publication Data

US 2018/0222712 A1 Aug. 9, 2018

(51) Int. Cl.

| | |
|---|---|
| ***B65H 35/02*** | (2006.01) |
| ***B65H 20/34*** | (2006.01) |
| ***B65H 18/10*** | (2006.01) |

(52) U.S. Cl.

CPC ..... *B65H 35/02* (2013.01); *B65H 18/103* (2013.01); *B65H 20/34* (2013.01); *B65H 2301/41486* (2013.01); *B65H 2408/217* (2013.01); *B65H 2601/511* (2013.01)

(58) Field of Classification Search

CPC ..... B65H 35/02; B65H 20/34; B65H 18/103; B65H 2601/511; B65H 2408/217; B65H 2301/41486

See application file for complete search history.

(56) References Cited

U.S. PATENT DOCUMENTS

| | | | | |
|---|---|---|---|---|
| 4,293,101 | A * | 10/1981 | Dunaevsky | B65H 18/103 242/413.4 |
| 4,621,777 | A * | 11/1986 | O'Connor | B65H 18/16 156/185 |
| 5,516,058 | A * | 5/1996 | Omokawa | B65H 23/198 242/413.6 |
| 9,278,509 | B2 * | 3/2016 | Hou | B32B 37/20 |
| 9,586,390 | B2 * | 3/2017 | Hou | B32B 38/0004 |
| 2003/0213430 | A1 * | 11/2003 | Ito | B65H 18/103 118/500 |
| 2010/0243788 | A1 * | 9/2010 | Oku | B65H 23/038 242/525 |
| 2014/0087198 | A1 * | 3/2014 | Hou | B32B 27/30 428/474.4 |
| 2016/0185094 | A1 * | 6/2016 | Hou | B32B 38/0004 156/193 |
| 2017/0327339 | A1 * | 11/2017 | Vergentini | B65H 35/02 |

* cited by examiner

*Primary Examiner* — William E Dondero

(57) ABSTRACT

A length adjusting mechanism of slitter rewinder, comprising a feeding device, a slitting device, a rewinding device, and a control device, the slitting device and the rewinding device including a length adjusting device therebetween which enables simultaneous completion of rewinding strips of material of multiple winding drums installed on this invention.

5 Claims, 7 Drawing Sheets

LENGTH ADJUSTING MECHANISM OF SLITTER REWINDER

BACKGROUND OF THE INVENTION

(1) Technical Field

The present invention, relates generally to a roiled material, slitting equipment and more particularly to a one-to-many length adjusting equipment which is applied after the material is slit.

(2) Background Art

Slitter rewinder is an equipment used for slitting roll of material vertically into multiple narrower strips according to the specified width and rewinding such narrower strips of material according to the specified lengths. It is commonly used in slitting cloth and plastic film, etc.

Generally, during the process of rewinding the strips of material one servomotor is used to control multiple rewinding shafts. Yet, since the rewinding shafts are in different positions, some rewinding shafts may finish rewinding earlier than others but keep operating till all other shafts finish rewinding, resulting in rewinding extra scraps.

BRIEF SUMMARY OF THE INVENTION

To solve the above-mentioned problem, the technology of the present invention designs a length, adjusting device between the slitting device and the rewinding device. Said length adjusting device comprises of: a mount and an adjusting unit fixed on the mount. Said adjusting unit comprises of: at least a group of guide rolls end each group of guide rolls comprises of two parallel primary guide rolls and at least one secondary guide roll between the two primary guide rolls and below the two primary guide rolls.

BRIEF DESCRIPTION OF THE SEVERAL VIEWS OF THE DRAWINGS(S)

DETAILED DESCRIPTION OF THE INVENTION

Figure 1:
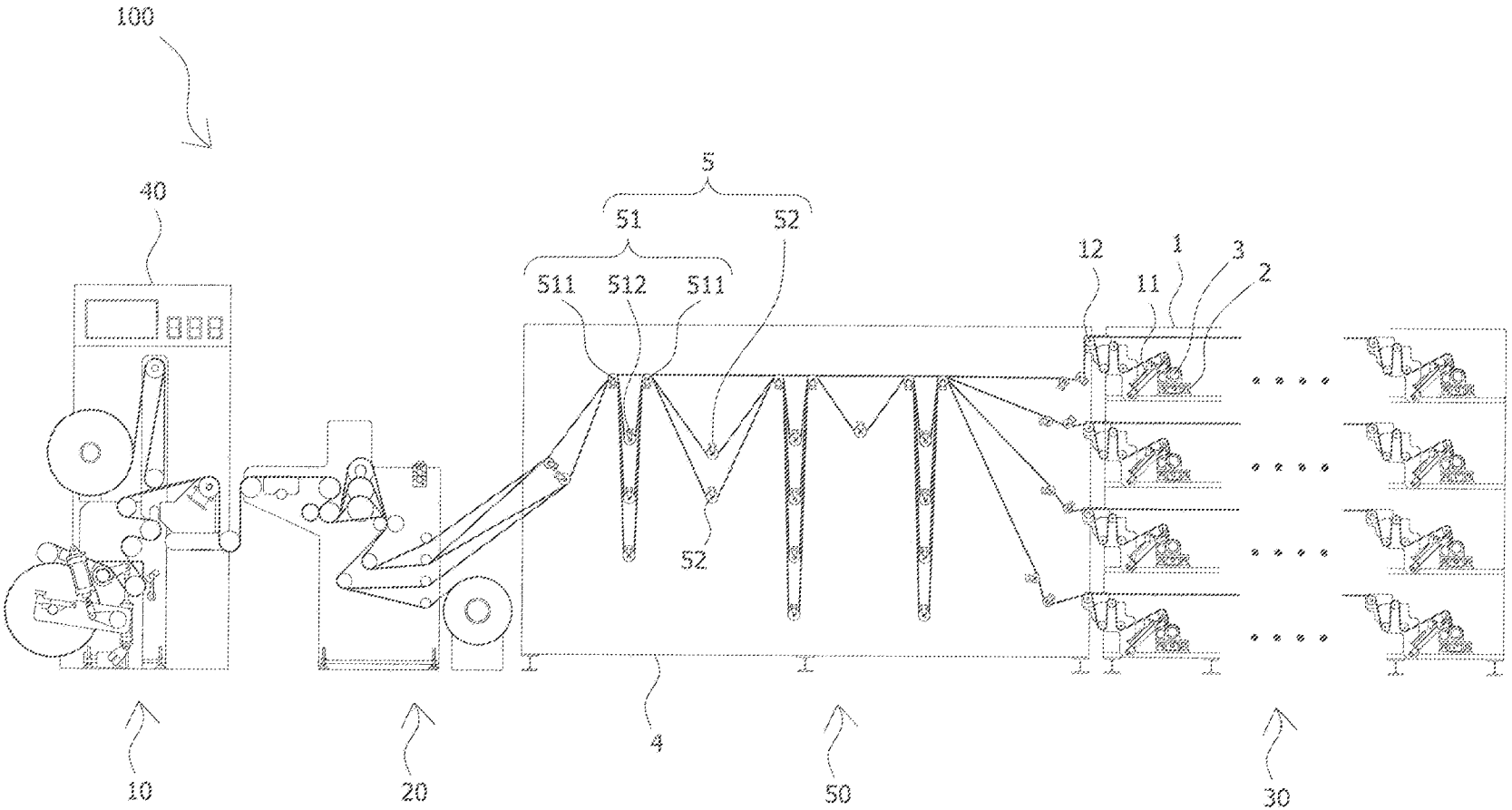
FIG. 1 is a schematic diagram of the slitter rewinder of the present invention.

The slitter re winder (100) shown in FIG. 1 comprises of: a feeding device (10), a slitting device (20), a rewinding device (30) and a control device (40). Said feeding device (10) is designed for installation and transmission of rolls of material; said slitting device (20) is set next to the feeding device (10) and it is designed for slitting rolls of material transmitted by the feeding device (10) into strips; the rewinding device (30) is set next to the slitting device (20) and it is designed for rewinding the strips of material; said control device (40) is a programmable logical controller electrically connected with the feeding device (10), slitting device (20) and rewinding device (30). Said rewinding device (30) comprises of: a substrate (1), several rail groups (2) mounted on the substrate (1) and several rewinding groups (3) on the substrate 1 and corresponding to the rail groups (2). It is characterized in that:

A length adjusting device (50) is set between said slitting device (20) and said rewinding device (30). The length adjusting device (50) comprises of: a mount (4) and an adjusting unit 5 fixed on the mount (4). Said adjusting unit (5) is designed for adjusting the strips of material so that they can arrive at the corresponding rewinding group (3) at the same time. Said adjusting unit (5) comprises of: at least a group of guide rolls (51) and each group of guide roils (51) comprises of two parallel primary guide rolls (511) and at least one secondary guide roll between the two primary guide rolls (511) and below the two primary guide rolls (511). Particularly, at least two secondary guide rolls (512) should be configured and the guide rolls (512) should be aligned end to end.

Figure 2:
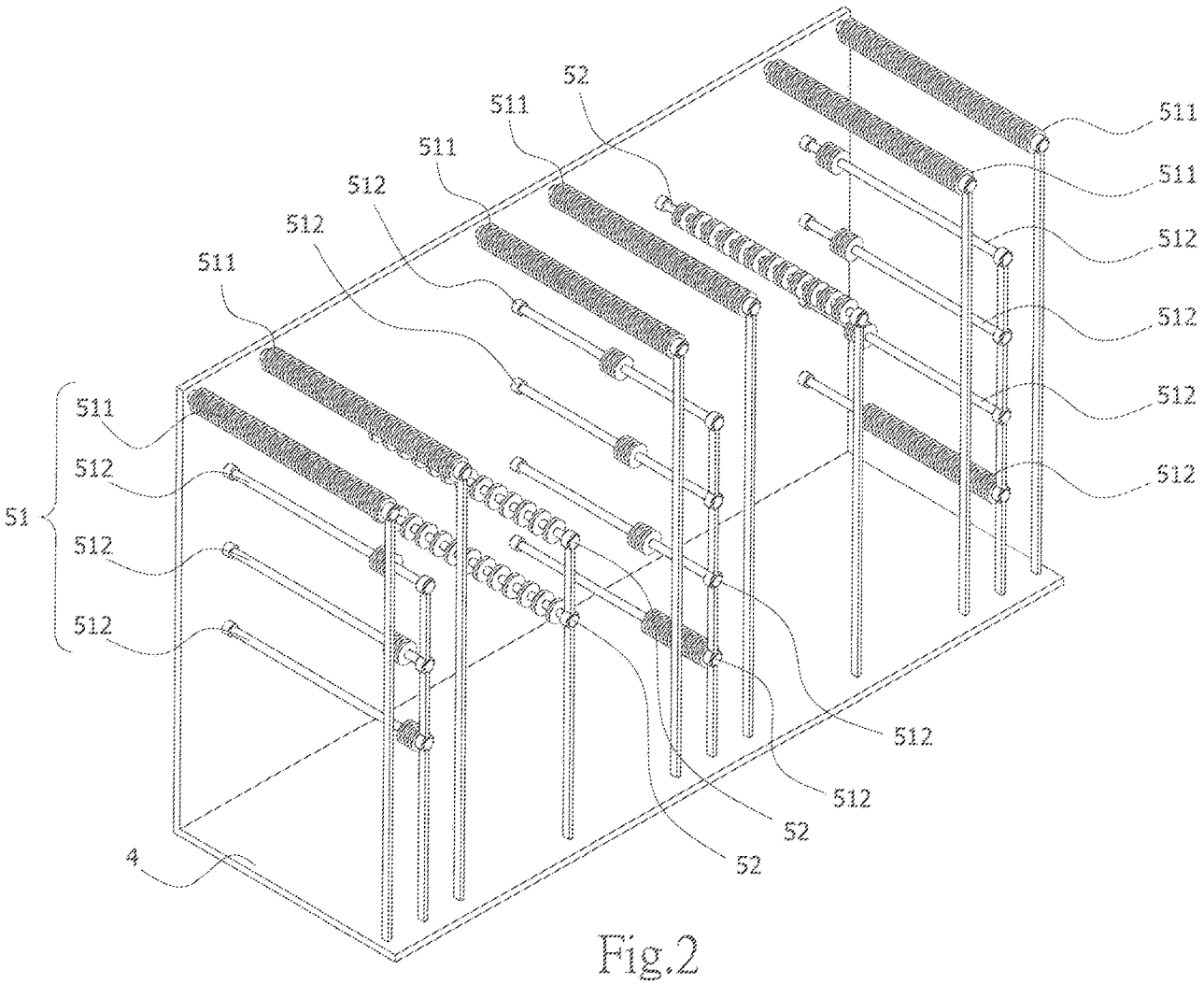
FIG. 2 is a stereogram of the length adjusting device of FIG. 1.

As shown in FIG. 2, the length adjusting device (50) comprises of a mount 4 and an adjusting unit (5) and the adjusting unit (5), based on the positions of the rewinding group (3), has various configured positions and forms.

Figure 3:
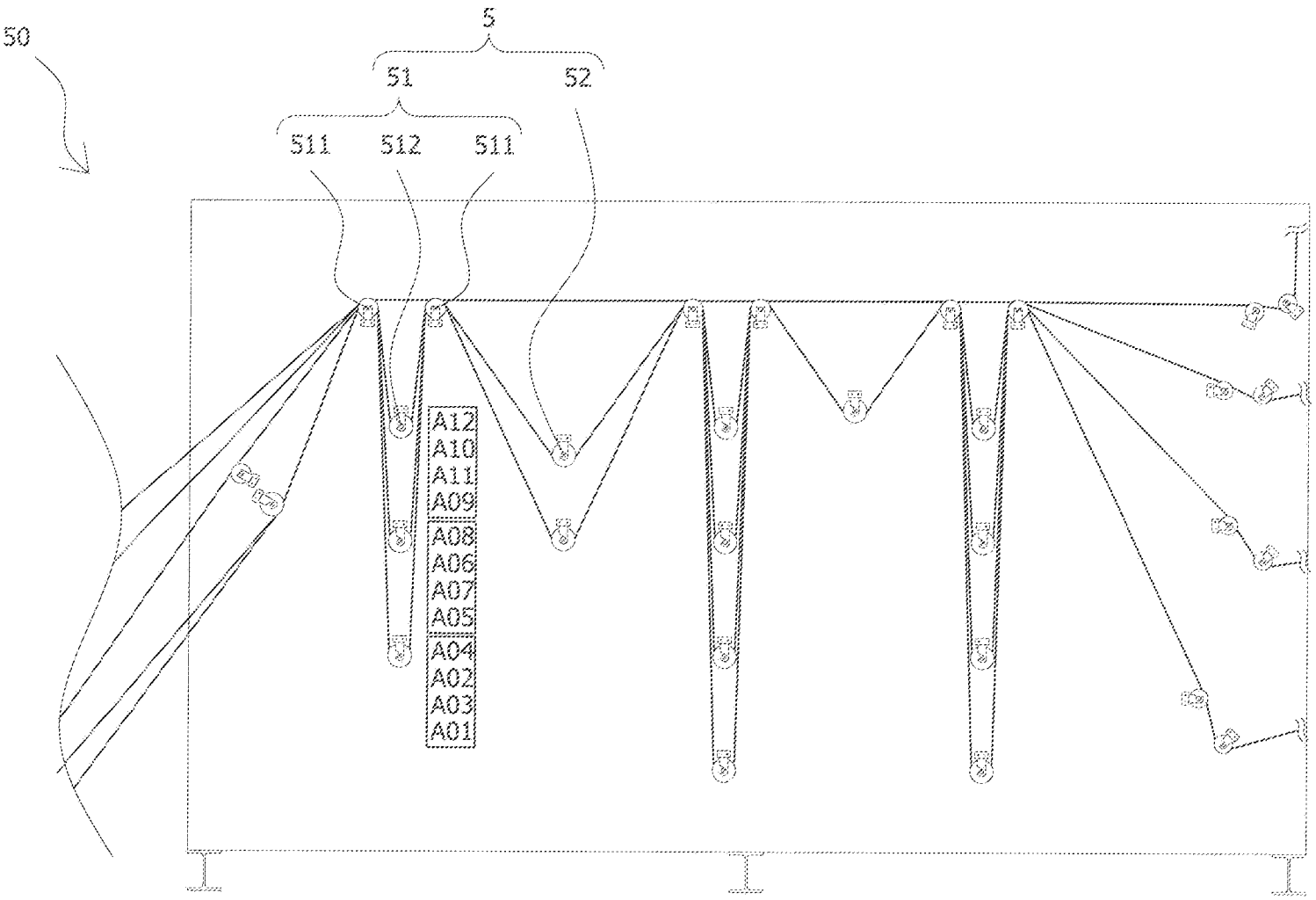
FIG. 3 is a schematic diagram, of the roll of material running through the length adjusting device of FIG. 1.
Figure 4:
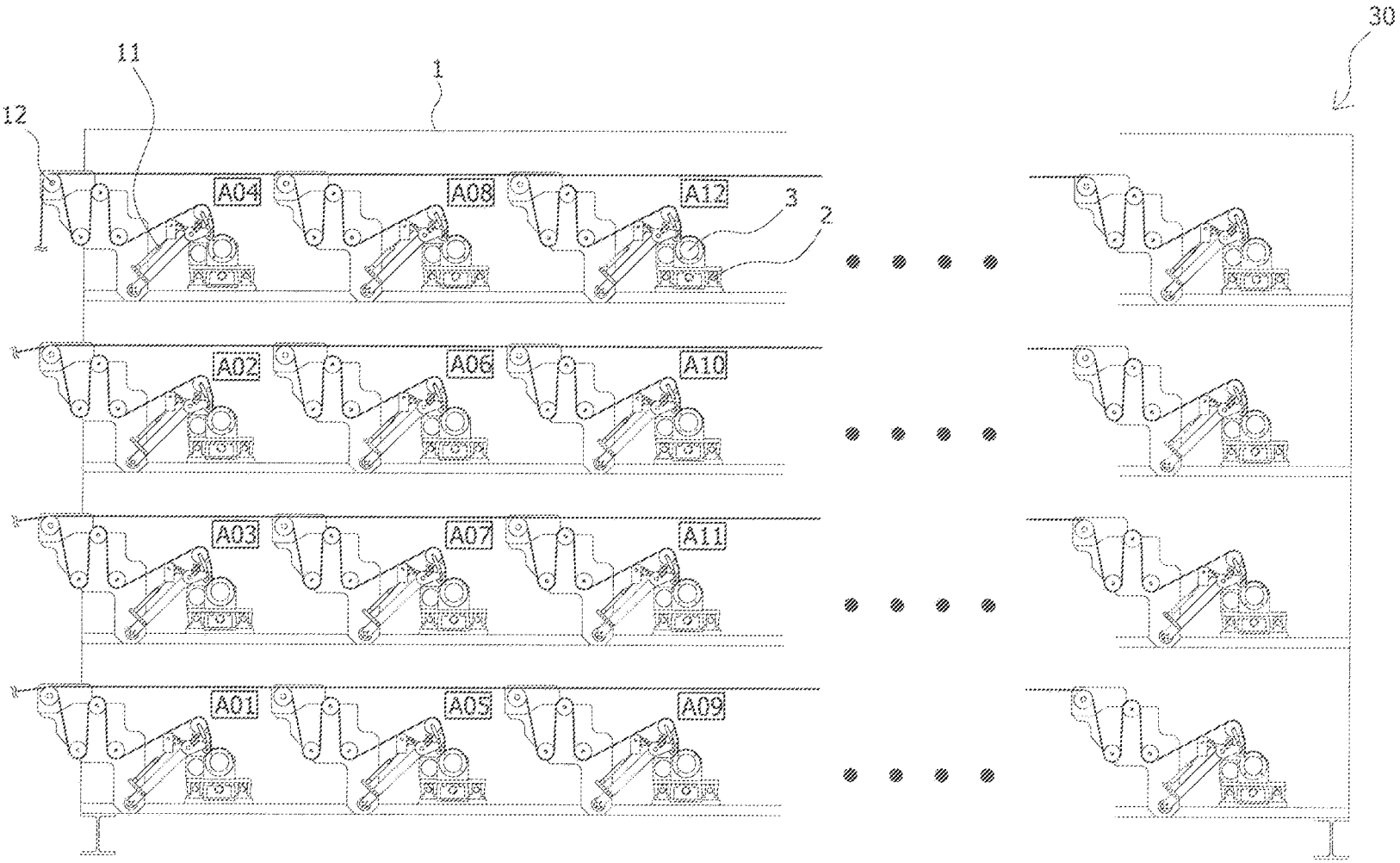
FIG. 4 is a schematic diagram of the strips of material rewound by the rewinding device of FIG. 1.

As shown in FIG. 3 and FIG. 4, the group of guide rolls (51) comprises of primary guide rolls (511) and secondary guide rolls (512). When the roll of material is slit into multiple strips, the primary guide rolls 511, the secondary guide roils (512) and the rewinding group (3) are numbered A01-A12 corresponding to each narrower strip of material and the strips will run through the primary guide rolls (511) and the secondary guide rolls (512), and respectively arrived at the corresponding rewinding group (3).

For example, the strips of material A01-A04 are corresponding to the positions of the rewinding group (3) shown in FIG. 4 and the strips run through the primary guide rolls 511 and a group of the secondary guide rolls (512) as shown in FIG. 3 while the strips of material A05-A08 are corresponding to the positions of the rewinding group (3) shown in FIG. 4 and the strips ran through the primary guide rolls (511) and another group of the secondary guide rolls (512) as shown in FIG. 3, and so forth, for the strips of material A09-A12. Hence, in tins way, the distance of the roll of material in feeding can be adjusted so that the end of the strips of material can arrive at the rewinding shafts (32) at different positions at the same time and the multiple strips of material can be rewound neatly and have the same diameter.

In the case above, if over two groups of guide rolls (51) are configured, they should be aligned side to side and the second group of guide roils 51 should at least have one guide lead roll (52). If there are over two lead roils (52), they should be aligned end to end.

The configured quantity of the above-mentioned group of guide rolls (51) is determined based on the quantity of the rewinding shafts (32) and the positions of such rewinding shafts (32). Additionally, at least one lead roll (52) should be configured between two groups of guide rolls (52) to ensure the ends of strips of material can arrive at the rewinding shafts (32) at different positions at the same time.

The above-mentioned substrate 1 is set at one side of the rewinding group (3) correspondingly and has press wheel group (11) designed for leading the strips of material to the rewinding group (3). Through the press wheel group (11), the strips of material before rewound by the rewinding group (3), are properly rewound by the rewinding shafts (32) based on the width of such strips of material to prevent the strips of material from crowning in rewinding. The rewinding diameter of press wheel group (11) is in linear variation according to the diameter of strips of material so that the strips of material are neatly aligned without shedding, which further raises the yield of operation.

Moreover, said substrate (1) at one side of the rewinding group (3) correspondingly at least has one lead roll (12) for leading strips of material.

Figure 5:
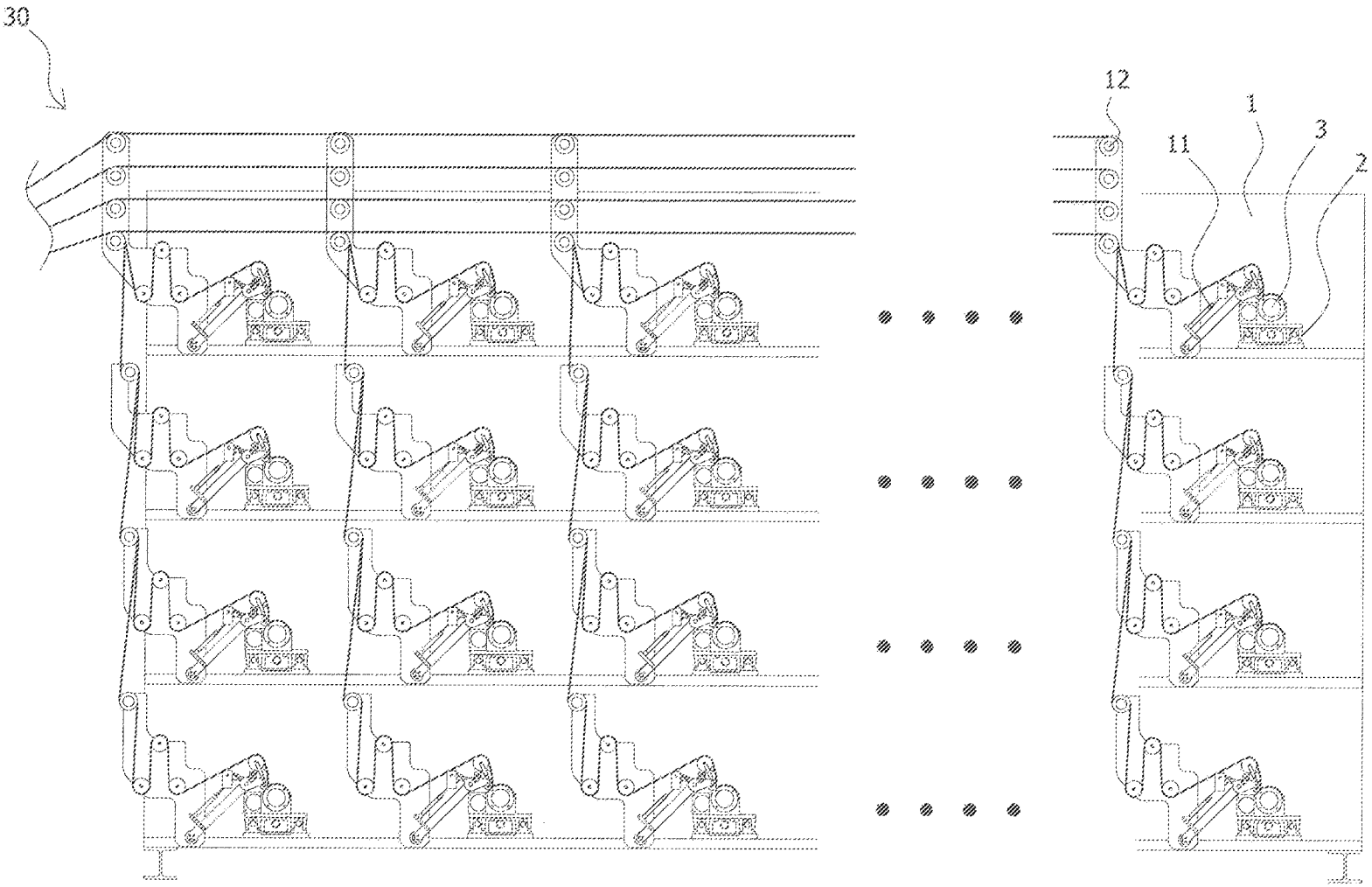
FIG. 5 is a schematic diagram of alternative embodiment of the present invention.

The above-mentioned rewinding device (30) has another embodiment. As shown in FIG. 5, the substrate (1) has several lead rolls (12) with each lead roll (12) having different configurations and forms based on the position of each rewinding shaft (32) to lead strips of material into the corresponding rewinding shaft (32).

Further, said control device (40) is a programmable logical controller installed at one side of the feeding device (10). It is designed for controlling the feeding device (10), the slitting device (20), the turnabout and rotation speed of the rewinding motor (33) as well as the power-take-off (PTO) value.

Additionally, the feeding device (10) has multiple control roll for tension control and has a main servo transmission to send the roll of material to the slitting device (20) for slitting. The feeding device (10) also has a pneumatic cylinder and pressure wheels. The pneumatic cylinder is used for driving the pressure wheels pressing the roll of material to prevent the roll of material from sliding in the transmission operation of the main servo transmission, in addition, there is a tension sensor designed for measuring the tension of roll of material. In case of low or high, tension, the corresponding signals will be sent to the control device (40) to ensure the appropriate tension of the roll of material.

The rewinding device (30) of the present utility model comprises of a substrate (1), several rail groups (2) mounted on the substrate (1) and several rewinding groups (3) on the substrate (1) and corresponding to the rail group (2).

Figure 6:
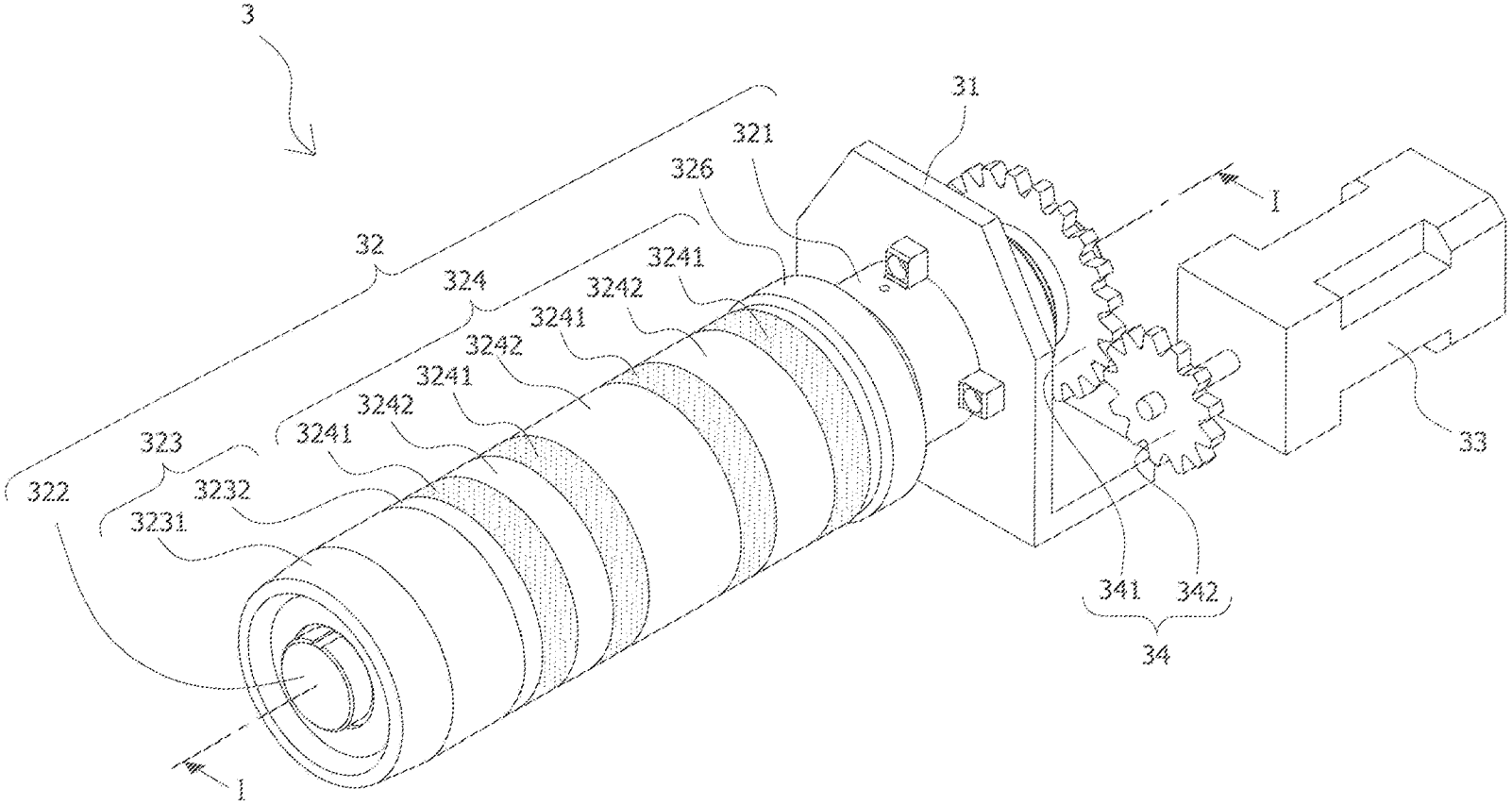
FIG. 6 is a 3D schematic diagram of rewinding device.

As shown in FIG. 6, the above-mentioned rewinding group (3) comprises of: a rewinding base (31), a rewinding shaft (32) connected to the rewinding base (31) for winding drum P (see FIG. 7) and a rewinding motor (33) for driving rotation of the rewinding shaft (32). Said rewinding shaft (32) comprises of a coupling shaft (321) installed on the rewinding base (31), a locating shaft (322) with one end connected to the coupling shaft (321), a movable set (323) at the other side of the locating shaft. (322) and a clamp set (324) put on the locating shaft (322) and between the coupling shaft (321) and the movable set (323). The clamp set (324) consists of several rubber loops (3241) and metal loops (3242) between the rubber loops (3241).

The above-mentioned movable set: (323) consists of a locating kit (3231) connected to the other side of the locating shaft (322) and a movable kit (3232) put on the locating shaft (322) and between such locating kit (3231) and the clamp set (324). In addition, said locating shaft (322) has a sleeve (326) between the coupling shaft (321 and the clamp set (324).

The above-mentioned rewinding group (3) has a transmission gear (34) between the rewinding shaft (32) and the rewinding motor (33). The transmission gear (34) includes a slave gear (341) connected to the rewinding shaft (32) and a master gear (342) connected to the rewinding motor (33).

Figure 7:
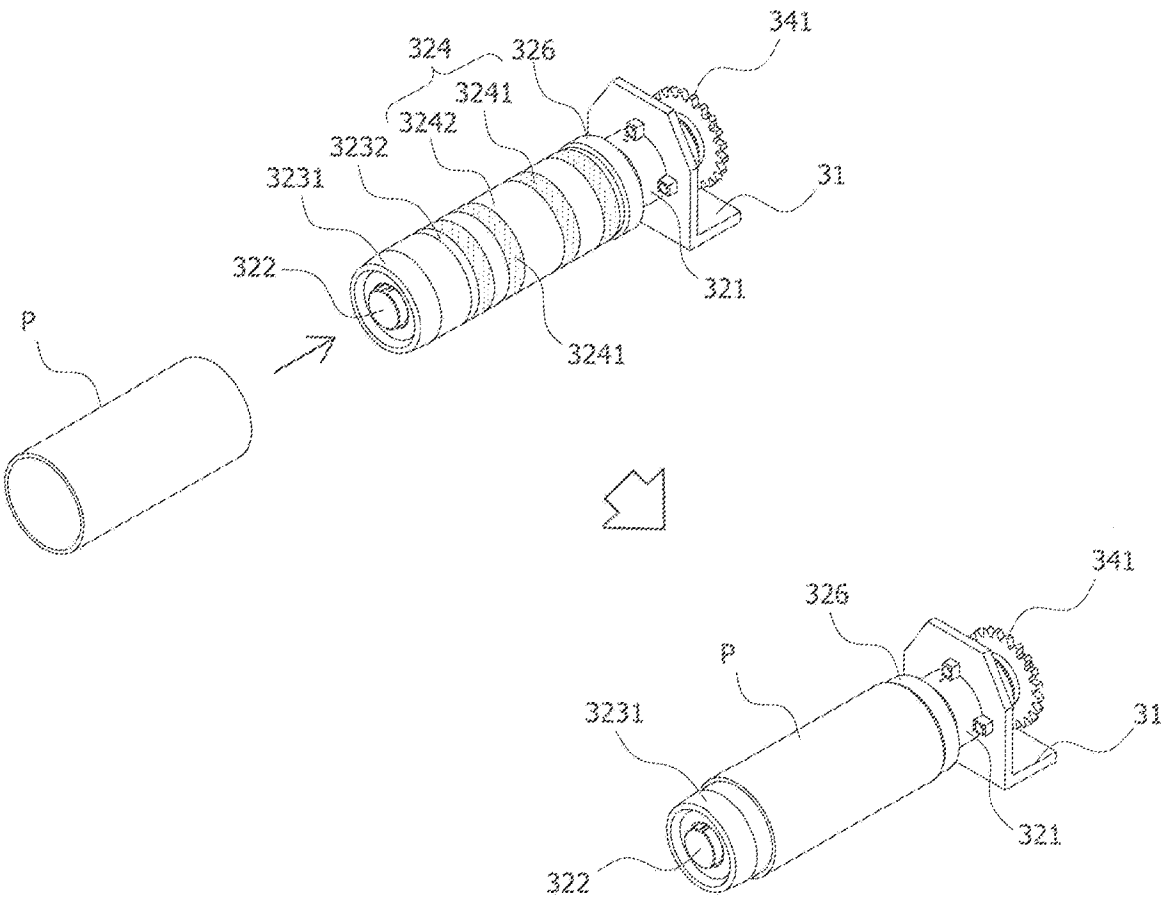
FIG. 7 is a schematic diagram of installation of winding drum into the rewinding group.

As shown in FIG. 7, the winding drum P is put on the clamp set (324) so that the winding drum P can be clamped by the clamp set (324) after expansion to ensure stability of the winding drum P.

The above only describes some exemplary embodiments of the present invention. Those having ordinary skills in the art may also make many modifications and improvements without departing from the conception of the invention, which shall all fall within the protection scope of the invention.

We claim:

1. A length adjusting mechanism of slitter rewinder, the slitter rewinder (100) comprising:

a feeding device (10), a slitting device (20), a rewinding device (30) and a control device (40);

wherein the feeding device (10) is configured for installation and transmission of rolls of material, the slitting device (20) is disposed next to the feeding device (10) and configured for slitting rolls of material transmitted by the feeding device (10) into strips, the rewinding device (30) is disposed next to the slitting device (20) and configured for rewinding the strips of material, and the control device (40) is a programmable logical controller electrically connected with the feeding device (10), slitting device (20) and rewinding device (30); the rewinding device (30) includes a substrate (1), a plurality of rail groups (2) mounted on the substrate (1) and a plurality of rewinding groups (3) on the substrate (1) and corresponding to the rail groups (2);

wherein the slitting device (20) and the rewinding device (30) have a length adjusting device (50) disposed therebetween; the length adjusting device (50) comprises a mount (4) and an adjusting unit (5) fixed on the mount (4); the adjusting unit (5) is configured for adjusting the strips of material so that they can arrive at the corresponding rewinding group (3) at the same time and the adjusting unit (5) comprises at least a group of guide rolls (51); each group of guide rolls (51) comprises of two parallel primary guide rolls (511) and at least one secondary guide roll (512) between the two primary guide rolls (511) and below the two primary guide rolls (511).

2. The length adjusting mechanism of slitter rewinder defined in claim 1, wherein the secondary guide rolls (512) are aligned end to end when two or more secondary guide rolls (512) are configured.

3. The length adjusting mechanism of slitter rewinder defined in claim 1, wherein the groups of guide rolls (51) are aligned side to side when two or more groups of guide rolls (51) are configured, and the groups of guide rolls (51) include at least one lead roll (52) disposed therebetween; the lead rolls (52) are aligned end to end when two or more of such lead rolls (52) are configured.

4. The length adjusting mechanism of slitter rewinder defined in claim 1, wherein the substrate (1) correspondingly disposed at one side of the rewinding group (3) comprises a plurality of pressure wheels (11) to lead the strips of material to the rewinding group (3).

5. The length adjusting mechanism of slitter rewinder defined in claim 1, wherein the substrate (1) disposed correspondingly at the one side of the rewinding group (3) comprises at least one lead roll (12) for leading strips of material.

* * * * *